US005163370A

United States Patent [19]

Platsch

[11] Patent Number: 5,163,370

[45] Date of Patent: Nov. 17, 1992

[54] POWDERING DEVICE FOR PRINTED ARTICLES

[76] Inventor: Hans G. Platsch, Kunferstr 40, D-W 7000 Stuttgart 80, Fed. Rep. of Germany

[21] Appl. No.: 659,327

[22] PCT Filed: Oct. 17, 1989

[86] PCT No.: PCT/EP89/01233

§ 371 Date: Feb. 28, 1991

§ 102(e) Date: Feb. 28, 1991

[87] PCT Pub. No.: WO90/05064

PCT Pub. Date: May 17, 1990

[30] Foreign Application Priority Data

Nov. 11, 1988 [DE] Fed. Rep. of Germany ... 8814129[U]

[51] Int. Cl.[5] ..... B41F 35/06

[52] U.S. Cl. ..... 101/424.2; 101/416.1

[58] Field of Search ..... 101/416.1, 420, 424.2

[56] References Cited

U.S. PATENT DOCUMENTS

| | | | |
|---|---|---|---|
| 2,110,052 | 3/1938 | Paasche | 101/420 |
| 2,110,218 | 3/1938 | Green et al. | 101/420 |
| 3,333,570 | 8/1967 | Paasche | 101/424.2 |
| 4,024,815 | 5/1977 | Platsch | 101/416.1 |
| 4,622,896 | 11/1986 | Laverick | 101/416.1 |
| 4,867,063 | 9/1989 | Baker et al. | 101/424.2 |

FOREIGN PATENT DOCUMENTS 2637875 2/1978 Fed. Rep. of Germany .

*Primary Examiner*—Edgar S. Burr
*Assistant Examiner*—Lynn D. Hendrickson
*Attorney, Agent, or Firm*—Fred Philpitt

[57] ABSTRACT

A powder dusting apparatus for dusting printed products with fine powder has a plurality of nozzle bodies (42) arranged in parallel one beside the other, which emit the powder mist. The spacing of the nozzle bodies (42) can be adjusted by a thread drive (26, 66) and a lazy tongs arrangement (52).

22 Claims, 7 Drawing Sheets

POWDERING DEVICE FOR PRINTED ARTICLES

The invention relates to an apparatus for dusting printed products with fine powder according to the preamble of claim 1.

Apparatus of this type are installed above the conveying path of the printed products on printing presses and dust the printed side of the freshly printed product with fine powder, in order that the printed products do not stick together by way of the layers of ink, when they are laid one on top of the other. The fine powder particles consisting of corn starch, $CaCo_3$ or sugar have a particle size of generally between 10 and 50$\mu$ and are atomized in an air stream. This mist is directed by way of generally bar-shaped nozzle bodies towards the printed products, the axis of the bar body extending parallel to the conveying direction of the printed products and a plurality of such nozzle bodies being arranged in parallel one beside the other above the conveying path of the printed products.

The curtain of mist produced as a whole by the nozzle body arrangement must be so wide that it still completely covers even the widest printed products. If smaller printed products are printed, then one must either tolerate the fact that the part of the powder curtain which is laterally outside the printed product is produced to no avail and enters parts of the machine located below the conveying path of the printed products. This is a drawback both with regard to contamination of the machine as well as with regard to the cost of the powder material. If, on the other hand, the nozzle body arrangement is changed so that the width of the powder curtain corresponds to the width of the printed product, this involves a longer stoppage of the printing press, which is economically viable solely with very large numbers of copies.

The present invention therefore intends to provide an apparatus for dusting printed products with fine powder according to the preamble of claim 1, in which the width of the powder curtain produced by the nozzle body arrangement can be varied at short notice and without complicated adjustment work.

This object is achieved according to the invention by a dusting apparatus according to claim 1.

In the dusting apparatus according to the invention, only a single element has to be operated in order to vary the transfer spacing of the nozzle bodies, namely the actuating member for the spacing adjusting means. The position of the individual nozzle bodies necessary respectively according to the position of this individual actuating member is, on the contrary reached automatically and thus quickly.

Advantageous developments of the invention are described in the Sub-claims.

With the development of the invention according to claim 2, a strictly uniform, synchronous adjustment of the individual nozzle bodies is obtained in a simple manner, since it is sufficient to impart a predetermined relative movement to two separate points of the lazy tongs arrangement, which are selected at random, in order to obtain the desired synchronous adjusting movements of the nozzle bodies.

The same advantage is provided by a dusting apparatus according to claim 3.

In a dusting apparatus according to claim 5, one can displace the various nozzle bodies not solely strictly in synchronism by the same distances, but also by different distances, which have a fixed predetermined ratio with respect to each other. Nevertheless, only a single, mechanically moved drive rod is required, so that the mechanical construction of the dusting apparatus is simple.

With the development of the invention according to claim 6, it is ensured that after the adjustment, the nozzle bodies are respectively locked automatically in a reliable manner in the position to which they have been moved.

In a dusting apparatus according to claim 7, one has a finely regulated lateral adjustment of the nozzle bodies in conjunction with a very simple mechanical construction of the switching couplings, which control the adjusting movement of the individual nozzle bodies.

In this case, with the development according to claim 8, positive locking of the nozzle bodies is ensured in a very simple manner for all times when no adjusting movement is ordered.

The development of the invention according to claim 9 makes it possible to undertake the adjustment of the individual nozzle bodies in a more variable manner, since the synchronisation can be changed by the control in a simple manner, for example by re-programming.

The same advantage is achieved with the development of the invention according to claims 11 and 12.

A mechanically rigidly coupled adjustment of the individual nozzle bodies is achieved according to claim 13 in a mechanically particularly simple manner.

In this case, the development of the invention according to claim 14 is characterised by a particularly compact and again mechanically simplified construction.

With the development of the invention according to claim 15 it is ensured that the adjusting paths of adjacent nozzle bodies may overlap somewhat, but nevertheless the means for the continuous adjustment of the spacing between the nozzle bodies have a mechanically very simple construction.

The development of the invention according to claim 16 is an advantage with regard to the construction of the spacing adjustment means using identical threaded spindles.

The development of the invention according to claim 17 is an advantage with regard to a reliable and tilt-free adjustment of long nozzle bodies.

With the development of the invention according to claim 18 it is ensured that long, bar-shaped nozzle bodies may also be set up obliquely with respect to the conveying direction of the printed products. Each of the nozzle bodies then covers a transverse region of the printed products, which corresponds to the opening angle of the partial curtain produced thereby plus the transverse stagger of its ends. This makes it possible to work with nozzle bodies which produce a mist cone which is not widened out excessively. Such mist cones which are widened out considerably necessarily lead to a greater fraction of the powder material being lost.

In a dusting apparatus according to claim 20, one automatically obtains an adaptation of the width of the powder mist produced by the individual nozzle bodies to the respective spacing of the nozzle bodies.

This variation of the jet width synchronous with the adjustment of the spacing is achieved according to claim 21 in a simple mechanical manner.

With the development of the invention according to claim 22 it is thus ensured that powder mist cannot escape upwards from the dusting apparatus.

The invention will be described in detail hereafter by means of embodiments, with reference to the drawings, in which.

Figure 1:
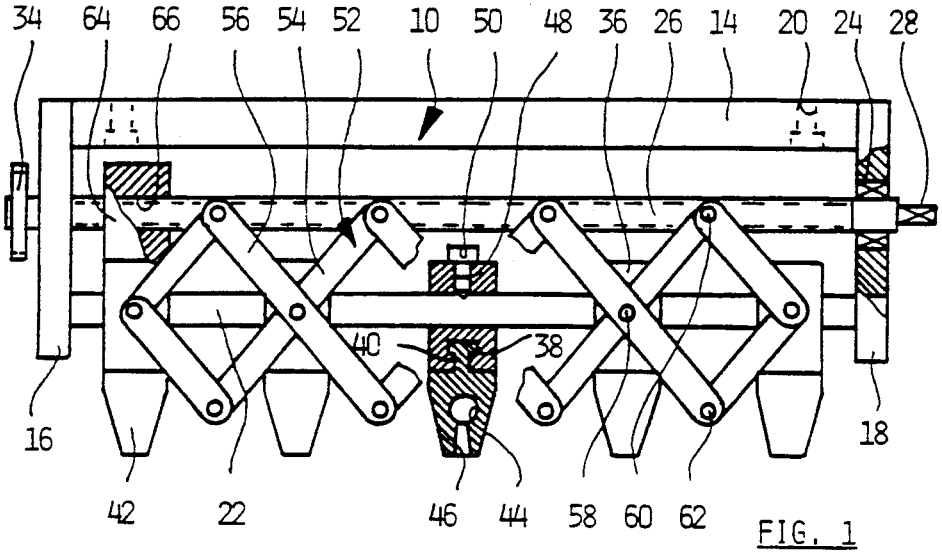
FIG. 1 is a plan view of the end face of a powder dusting apparatus, in which some parts are cut away.
Figure 2:
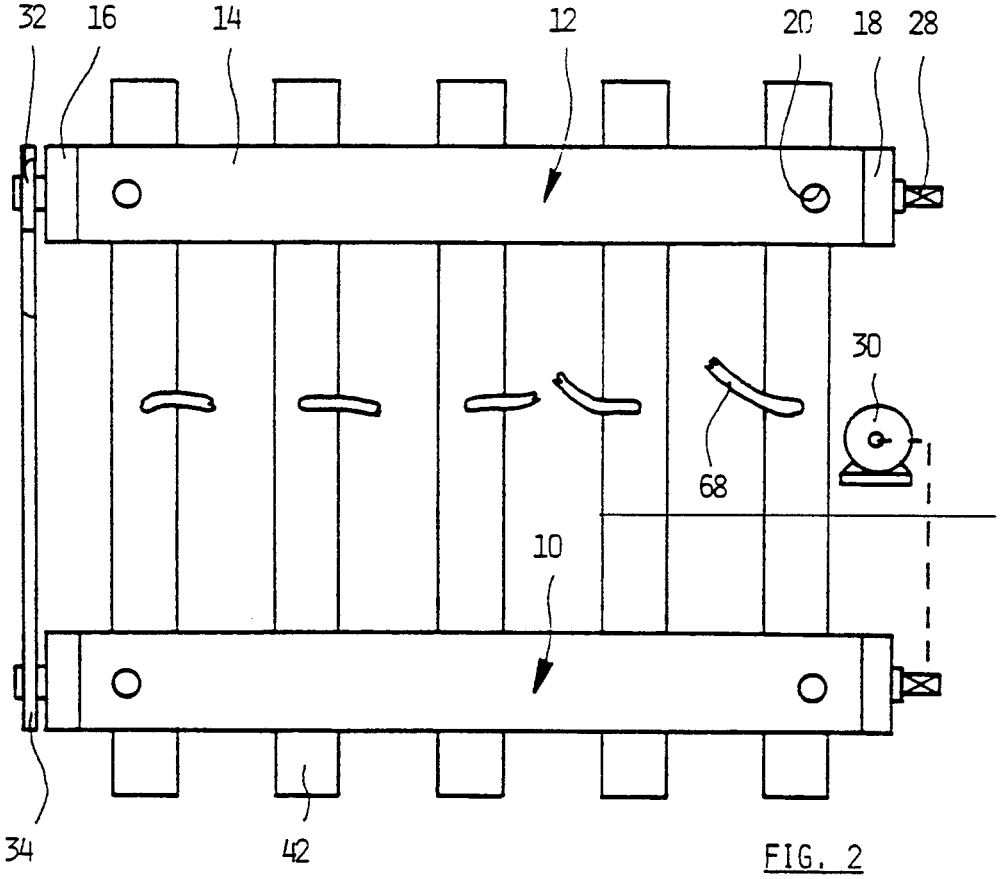
FIG. 2 is a plan view of the powder dusting apparatus according to FIG. 1.

The powder dusting apparatus illustrated in FIGS. 1 and 2 has two substantially U-shaped support frames 10, 12, which each comprise a fastening plate 14 as well as lateral bearing arms 16, 18.

Provided in the fastening plate 14 are bores 20, in which fixing screws can be housed, which serve for attaching the support frames 10, 12 to horizontal struts of a printing press or for attaching the support frames 10, 12 to a support plate, which is not shown in detail in the drawing, which is then in turn attached to a printing press.

A square guide rail 22 is fixed in the bearing arms 16, 18, in the lower section. A threaded spindle 26 is mounted in the bearing arms 16, 18 using axial/radial bearings 24, in parallel above the guide rail 22. This threaded spindle 26 has a square driving section 28, which is connected mechanically to an electric motor 30.

The left-hand ends of the threaded spindles 26 support chain wheels 32, over which a chain 34 travels. In this way, the threaded spindle 26 of the rear support frame 12, which is not connected to a motor, is connected to the driven threaded spindle 26 of the front support frame 10.

Several guide heads 36 are able to move with sliding clearance on the guide bar 22. The guide heads 36 each have on the under side a retaining groove 38 having a T-shaped cross-section, extending at right angles to the plane of the drawing of FIG. 1, which retaining groove 38 receives in a slideable and rotary manner a rotationally symmetrical retaining pin 40 having a complementary cross-section, which projects upwards from the upper side of an associated nozzle bar designated generally by the reference numeral 42.

The nozzle bars 42 each have an internal distribution channel 44 extending in the longitudinal direction of the bar, which channel, by way of a plurality of downwardly pointing discharge nozzles, delivers a powder mist towards the printed products, which travel past below the nozzle bar arrangement.

In their upper section, the guide heads 36 have a threaded bore 48, into which a set screw 50 can be rotated, whereof the tip engages in the upper side of the guide rail 22. Of the various guide heads 36, only one single guide head is equipped with a set screw 50; in the embodiment illustrated in FIG. 1, this is the central guide head. This selected guide head serves as a fixed point at the time of adjustments of the nozzle bar 42 in the transverse direction.

In order that the guide heads 36 can necessarily be adjusted so that the distances between adjacent nozzle bars 42 are all the same size, a lazy tongs arrangement designated generally by the reference numeral 52 is provided, which has lattice links 54, 56 laid crosswise. At the cross-over point, the lattice links 54, 56 are each pivotally connected by a hinge pin 58 to one of the guide heads 36. The free ends of the lattice links 54, 56 are connected by hinge pins 60, 62.

One of the guide heads 36, which differs from the guide head 36 fixed by the set screw 50, in the embodiment illustrated in FIG. 1 the guide head 36 located furthest to the left, supports a drive head 64, which is provided with a tapped hole 66, which travels on the threaded spindle 26. By rotating the threaded spindle 26 in one or other direction of rotation, one can thus increase or reduce the spacing of the nozzle bars 42, the adjusting movement taking place symmetrically with respect to the fixed, central guide head and thus also the central nozzle bar. If, in place of the central guide head, one were to fix the guide head located furthest to the right in FIG. 1, then with an otherwise unchanged construction of the powder dusting apparatus illustrated in FIGS. 1 and 2, one would obtain a uniform increase or reduction of the nozzle bar spacing based on a fixed point, which lies at the right-hand end of the guide rail 22 in FIG. 1.

The distribution channels 44 of the various nozzle bars 42 are connected by way of flexible hoses 68 to an atomizer, which is not shown in detail. The powder mist is obtained by the atomization of fine particles from 10 to 50$\mu$, preferably 15 to 20$\mu$ consisting of corn starch, $CaCo_3$ or sugar in a compressed air stream.

It will be seen that the powder dusting apparatus illustrated in FIGS. 1 and 2 can be preset simply by energizing the electric motor 30 in one direction of rotation or the other for the dusting of printed products of different width. In this case, the printed products of different width may either be supplied to the centre of the printing press (central guide head fixed) or supplied so that one of their side edges travels in the same way along one side of the printing press (marginal guide head fixed).

Figure 3:
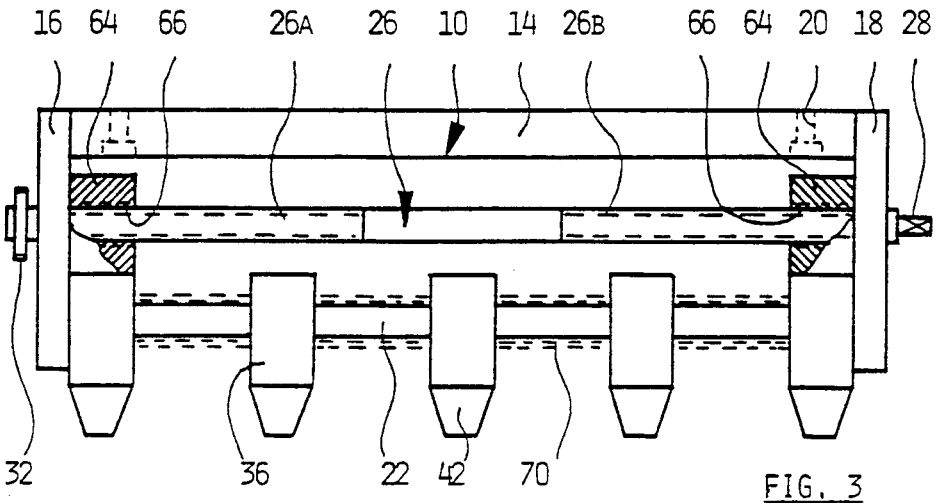
FIGS. 3 and 4 are views of a modified powder dusting apparatus similar to FIGS. 1 and 2.
Figure 4:
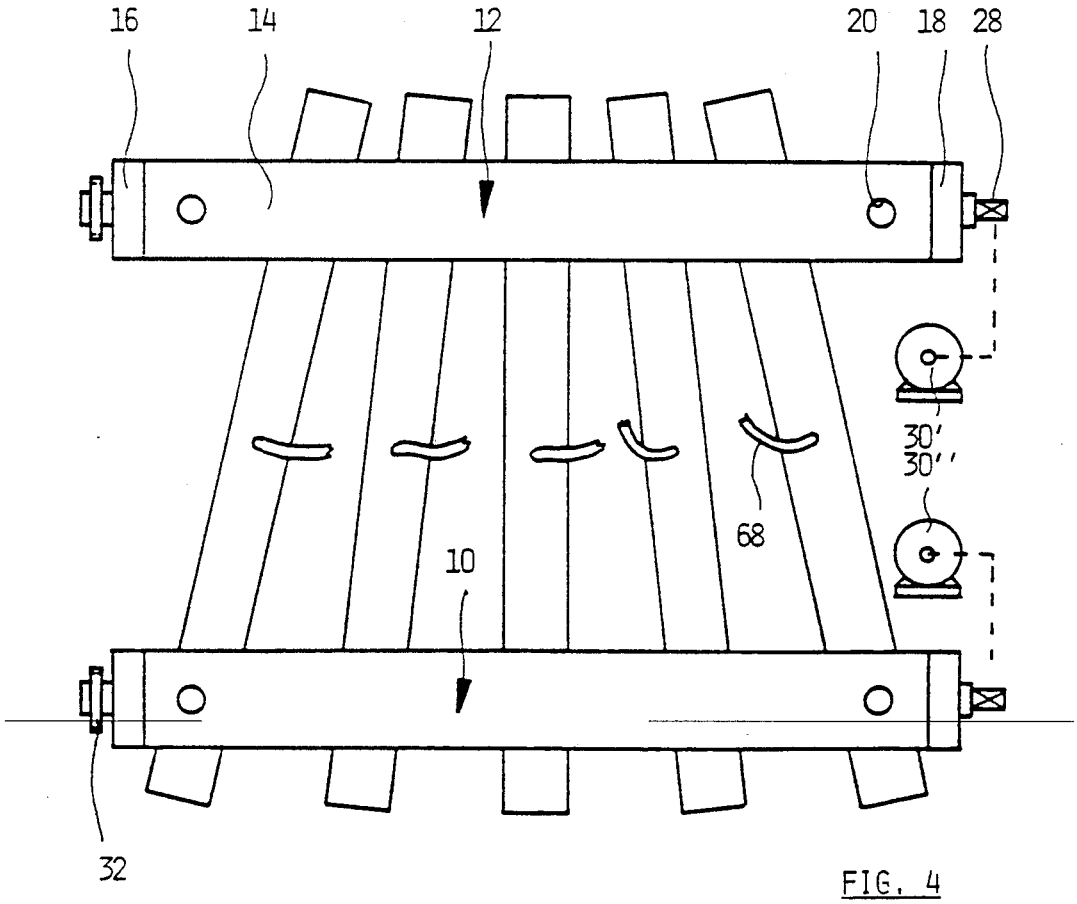

In the modified embodiment according to FIGS. 3 and 4, parts which have already been described above, are again provided with the same reference numerals.

Now however, the threaded spindle 26 has two spindle sections **26*a* and 26*b* provided with oppositely directed threads, which cooperate with two drive heads 64, which are fitted to the two marginal guide heads 36**. These marginal guide heads are thus necessarily moved symmetrically with respect to the central plane of the powder dusting apparatus.

In order to guarantee identical distances between the individual nozzle bars, helical springs 70 are now provided, which are respectively inserted between adjacent guide heads 36 arranged with a slight sliding clearance on the guide rail 22.

In the embodiment according to FIGS. 3 and 4, the coupling chain 34 also provided in the embodiment according to FIGS. 1 and 2 is omitted. The drive sections 28 of both threaded spindles 26 are respectively connected to an associated electric motor 30 or 30', so that the spacing of the guide heads and nozzle bars for the front and rear support frames can be adjusted to be different. One can thus also achieve an inclined position of the nozzle bars 42 with respect to the conveying direction of the printed products (in FIG. 4 from the top downwards), as shown in FIG. 4. Thus, each of the nozzle bars 42 is able to cover a transverse region of the printed products, which is greater than that which corresponds to the vertex angle of the mist produced by the individual nozzle bar 42. One can thus work with relatively acute mist jets and nevertheless cover the entire width of the printing press with a small number of nozzle bars 42. The small relative movements in the longitudinal direction of the bars, to be carried out at the time of tilting of the nozzle bars 42 are therefore possible, because the retaining pins 40 are seated in a longitudinally displaceable manner in the retaining grooves 38 of the guide heads 36.

Figure 5:
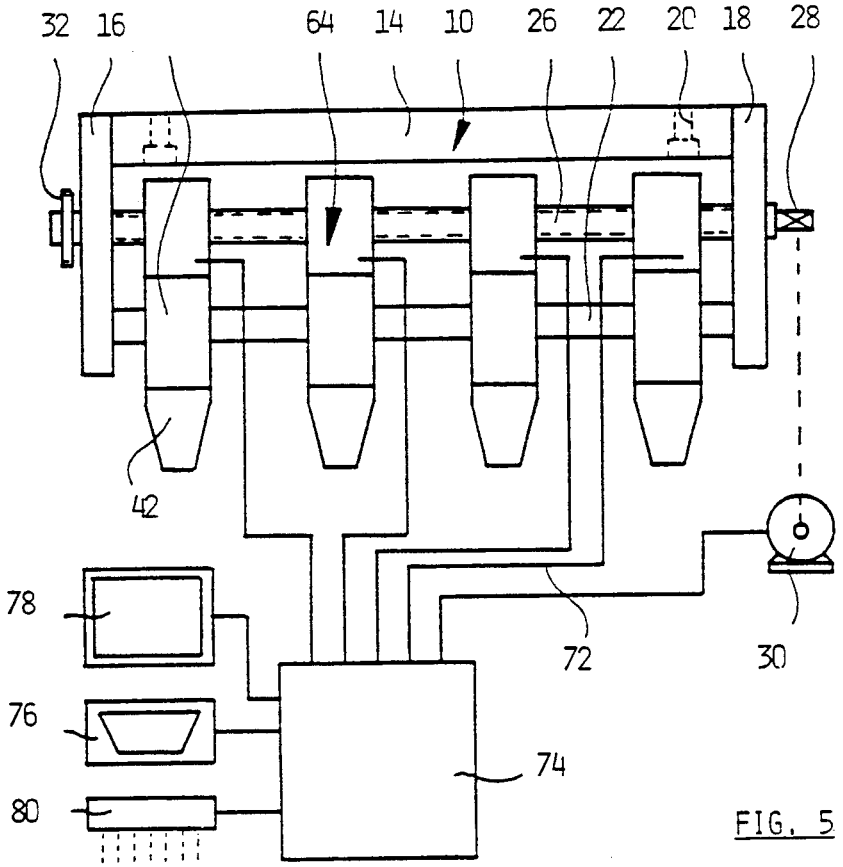
FIG. 5 is a view of a further modified powder dusting apparatus similar to FIG. 1.
Figure 6:
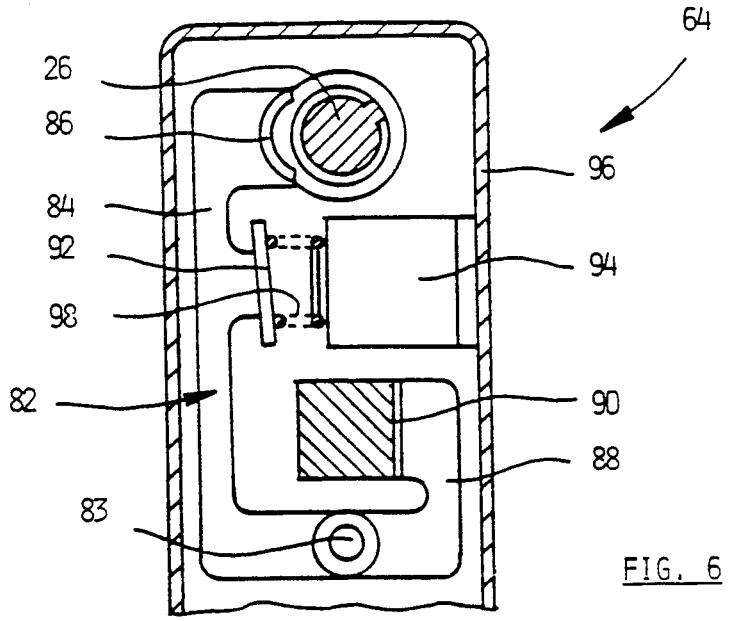
FIG. 6 is a vertical section through a guide/adjustment head for one of the nozzle bars of the powder dusting apparatus according to FIG. 5, to an enlarged scale.

In the embodiment according to FIGS. 5 and 6, an individual drive head 64 is associated with each of the guide heads 36, which guide head 64 travels on the threaded spindle 26. The drive heads 64 contain specially constructed switching couplings, by which they can be optionally connected to the threaded spindle 26 for driving, or disconnected therefrom. The control of these switching couplings, which will be described in more detail hereafter with reference to FIG. 6, takes place by way of control leads 72 using a computer 74, which cooperates with a keyboard 76, a monitor 78 as well as a multiple light barrier 80 covering the conveying path of the printed products in the transverse direction. Thus, the width of the powder mist produced by the nozzle bar arrangement can be adjusted either automatically according to the width of the printed products measured by the multiple light barrier 80 or selected according to values keyed-in on the keyboard 76.

As can be seen from FIG. 6, in the driving heads 64, in each case a two-armed lever 82 is mounted to rotate about a horizontal pin 83. At one end, one of its lever arms 84 supports a nut segment 86, which may travel on the threaded spindle 26. A second lever arm 88 of the lever 82 supports a brake member 90, which cooperates with one side face of the guide bar 22. Also located on the lever arm 84 is an armature plate 92, which cooperates with an electromagnet 94, which is attached to the housing of the drive head 64 designated by the reference numeral 96.

Clamped between the armature plate 92 and the end face of the electromagnet 94 is a helical compression spring 98, by which the lever 82 is biased in the position shown in FIG. 6, in which the brake member 90 bears against the guide rail 22 and the nut segment 86 is out of engagement with the threaded spindle 26. On the other hand, when the electromagnet 94 is energized, the brake member 90 is raised from the guide rail 22, the nut segment 86 is placed on the threaded spindle 26. Now, the driving head 64 under consideration and the guide head 36 connected thereto as well as the nozzle bar 42 supported thereby, are adjusted according to the rotation of the threaded spindle 26.

Roughly speaking, the computer 74 works so that it energizes the electric motor 30 as long as an adjusting movement of the drive head 64 is required. However, the electromagnets 94 of the various drive heads 64 are energized solely over part of this time interval, as this is necessary for adjusting the drive head 64 over different widths.

It will be seen that by corresponding programming of the computer 74, one can bring about an adjustment of the nozzle bars 64, taking place absolutely uniformly with respect to the central plane of the powder dusting apparatus, in exactly the same way as an asymmetrical or non-uniform adjustment of the various nozzle bars, in a predetermined manner.

For some applications, it is advantageous if at the same time as adjusting the spacing between adjacent nozzle bars 42, the delivery characteristic of the nozzle bars is also varied synchronously, thus the opening angle of the mist cone is increased as the spacing of the nozzle bars increases and reduced as the spacing of the nozzle bars decreases.

Figure 7:
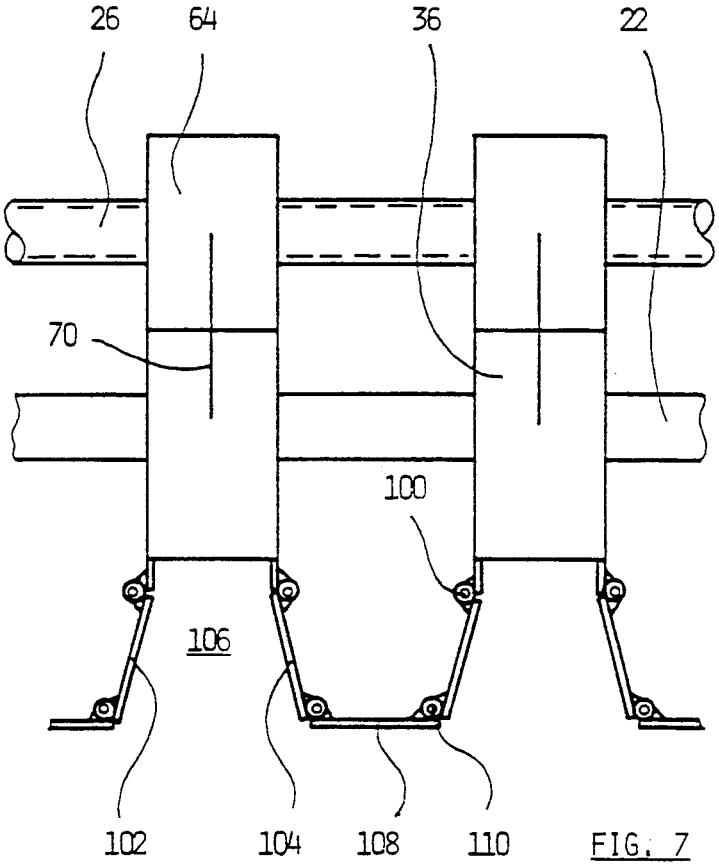
FIG. 7 is a cutaway view of a modified nozzle bar arrangement with a width of the powder mist delivered by the bars, which can be varied automatically according to the spacing of the bars.

FIG. 7 shows a mechanical solution for this compulsory variation of the jet characteristic in synchronism with the spacing of the nozzle bars.

The nozzle bars in each case have lateral duct walls 102, 104 pivoted by way of joints 100, which walls define a variable nozzle opening 106. The lower ends of the duct walls 102, 104 of adjacent nozzle bars 42 are respectively connected by horizontal coupling plates 108, and indeed by way of joints 110.

From FIG. 7 it can be seen directly that the width of the nozzle opening 106 is increased automatically, if the drive heads 64 are moved apart, reduced automatically, if the drive heads 64 are placed closer together. In addition, the coupling plates 108 together with the duct walls 102, 104 form a variable cover for the powder-filled space, in the upwards direction.

Figure 8:
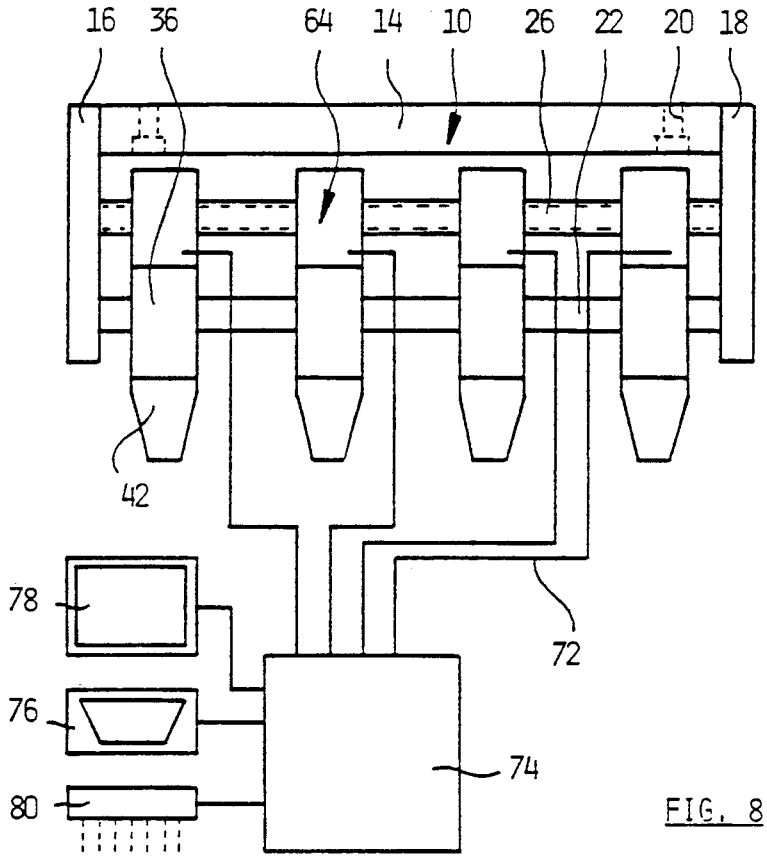
FIGS. 8 and 9 are views of a modified powder dusting apparatus similar to FIGS. 5 and 6.
Figure 9:
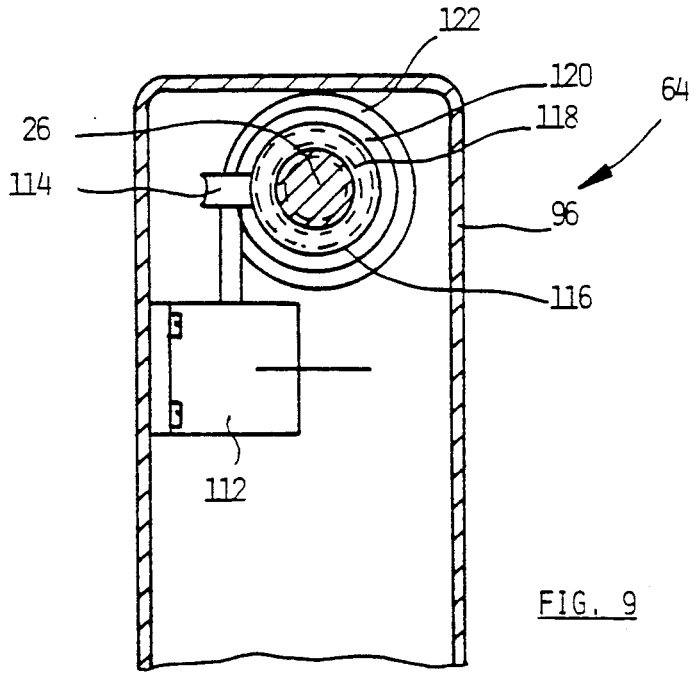

In the embodiment according to FIGS. 8 and 9, the components, which have already been described above with reference to FIGS. 5 and 6, are again provided with the same reference numerals and are not described again in detail.

The threaded spindle 26 is now held in a non-rotary manner by the bearing arms 16, 18 and the drive heads 64 each contain an independently controllable drive motor 112, which is controlled by the computer 74 in one or other direction of rotation. The drive motor 112 is in each case fixed to the housing 96 and its shaft supports a helical toothed gear 114, which meshes with a correspondingly helical toothed gear rim 116, which is located on the outside of a threaded sleeve 118. The threaded sleeve 118 has a bearing collar 120 axially remote from the toothed rim 116, which collar is mounted by way of an axial/radial bearing 122 in a side wall of the housing 96.

The threaded sleeve 118 travels on the threaded spindle 26 and by energizing the drive motor 112 in one direction of rotation or the other, the drive head 64 in question is thus moved towards the left or right on the threaded spindle 26. The computer 74 determines the movement of the various drive heads 64.

For the second ends of the nozzle bodies 42, the same adjusting device is provided, as is illustrated in FIGS. 8 and 9. The computer 74 likewise takes care of the control of the drive heads 64, in which case the drive heads 64 located one behind the other in the conveying direction of the printed sheets normally receive the same control signals.

Figure 10:
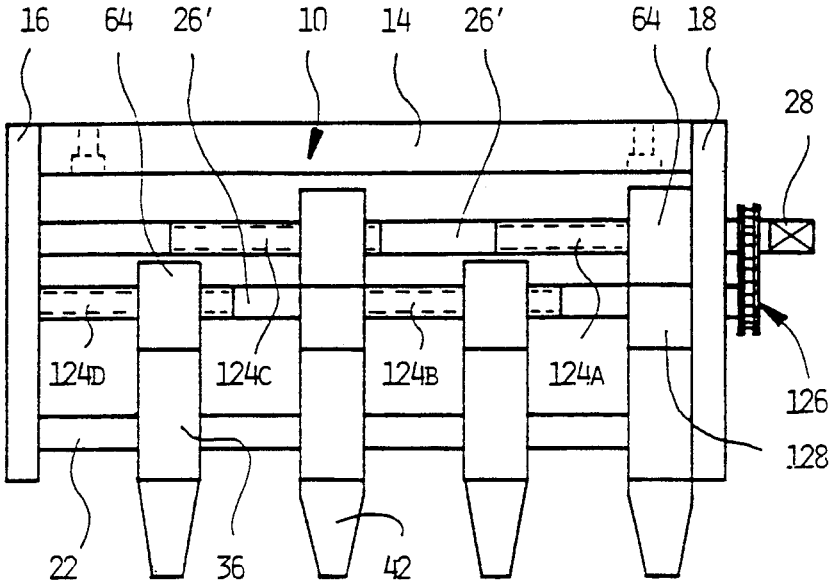
FIG. 10 is an end view of a further modified powder dusting apparatus.

Also in the embodiment according to FIG. 10, components which have already been described above, are again provided with the same reference numerals. Two threaded spindles 26' and 26'' are now arranged to rotate in the bearing arms 16, 18. Located on these threaded spindles are four threads **124*a*, 124*b*, 124*c* and 124*d* having a different pitch: the thread 124*b* has twice the pitch of the thread 124***a*; the thread 124*c* has three times the pitch of the thread 124*a* and the thread 124*d* has four times the pitch of the thread 124*a*. As shown in FIG. 10, the threads 124 overlap over a short distance and for this reason they are distributed on the two threaded spindles 26' and 26''. If one can tolerate a gap in the adjustment region of the spacing of the nozzle bodies 42, then the threads 124 can all be located on a single threaded spindle.

The threaded spindles 26' and 26'' are positively connected by a chain drive 126, thus they travel at the same speed.

At those nozzle bodies 42, which are driven by the threaded spindle 26', an intermediate member 128 is inserted between the drive head 64 and the guide head 36, which intermediate member engages with clearance over the threaded spindle 26''.

In the embodiment according to FIG. 10, by rotating the threaded spindle 26', the nozzle bars 42 are thus moved positively in the same manner as when using the lazy tongs 52 illustrated in FIG. 1.

Figure 11:
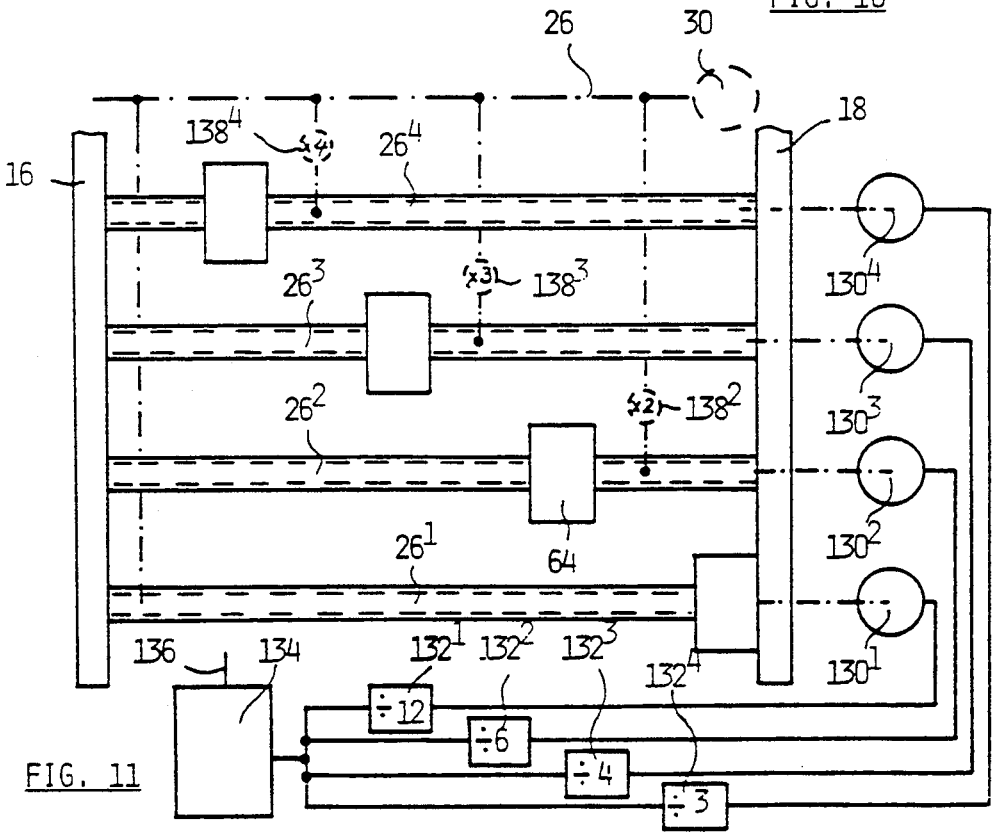
FIGS. 11 to 13 are plan views of further embodiments of a powder dusting apparatus.

In the further variation illustrated in FIG. 11, the drive heads 64 for the various nozzle bars cooperate with four different threaded spindles $\mathbf{26^1}$, $\mathbf{26^2}$, $\mathbf{26^3}$ and $\mathbf{26^4}$. In this case, the threaded spindle $\mathbf{26^2}$ travels twice as fast as the threaded spindle $\mathbf{26^1}$, the threaded spindles $\mathbf{26^3}$ and $\mathbf{26^4}$ travel three or four times as quickly.

Four stepping motors $\mathbf{130^1}$, $\mathbf{130^2}$, $\mathbf{130^3}$ and $\mathbf{130^4}$ act on the threaded spindles. The stepping motor $\mathbf{130^4}$ receives its control pulses by way of a frequency divider $\mathbf{132^4}$ with a dividing ratio "3" from the output of a pulse generator 134. The frequency divider $\mathbf{132^4}$ thus allows every third pulse supplied by the pulse generator 134 to pass. In a corresponding manner, the stepping motors $\mathbf{130^3}$, $\mathbf{130^2}$ and $\mathbf{130^1}$ receive the control pulses of the pulse generator 134 by way of frequency dividers $\mathbf{132^3}$, $\mathbf{132^2}$ and $\mathbf{132^1}$, whereof the dividing ratio amounts to "4", "6" and "12".

The pulse generator 134 itself is a controllable pulse generator and by way of a lead 136 receives a signal from the computer 74, which specifies the number of pulses to be emitted in each case by the pulse generator 134. This can take place for example by the transfer of a binary coded number, which advances a counter contained in the pulse generator 134, whereby in each case after receiving such a number, the pulse generator begins to produce pulses which are supplied simultaneously to a counting-down terminal of this internal counter and the emission of pulses ends when the counter is reset to zero.

In a variation shown in broken line in FIG. 11, one can again use a single electric motor 30, in order to drive a threaded spindle 26. The threaded spindle 26 then works directly on the threaded spindle $\mathbf{26^1}$, whereas the threaded spindles $\mathbf{26^2}$ to $\mathbf{26^4}$ are connected by way of transmissions $\mathbf{138^2}$ to $\mathbf{138^4}$ to the threaded spindle 26. The transmissions $\mathbf{138^2}$, $\mathbf{138^3}$ and $\mathbf{138^4}$ ensure a speed reduction by the factor "2", "3" and "4". The transmissions 138 may be gear drives, belt drives or chain drives.

Figure 12:
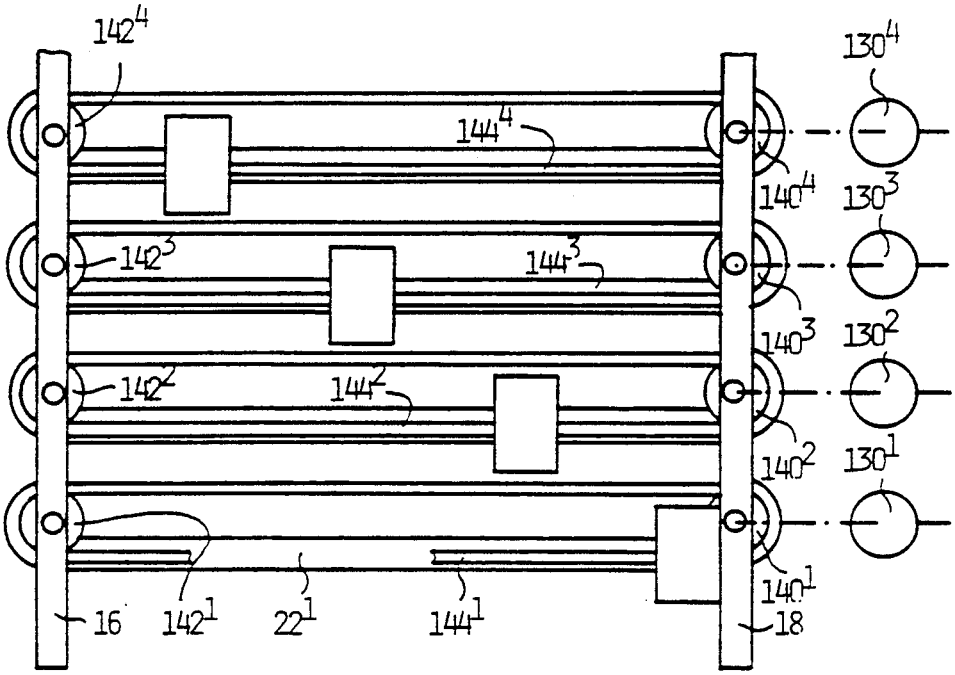

The embodiment according to FIG. 12 is very similar to that according to FIG. 11, only the stepping motors $\mathbf{130^i}$ act on deflection wheels $\mathbf{140^i}$ driven continuously in the bearing arms 18, which together with deflection in wheels $\mathbf{142^i}$ arranged to rotate freely in the bearing arm 16 and belts $\mathbf{144^i}$ travelling over these wheels, form a belt drive acting on an associated drive head $\mathbf{64^i}$.

Figure 13:
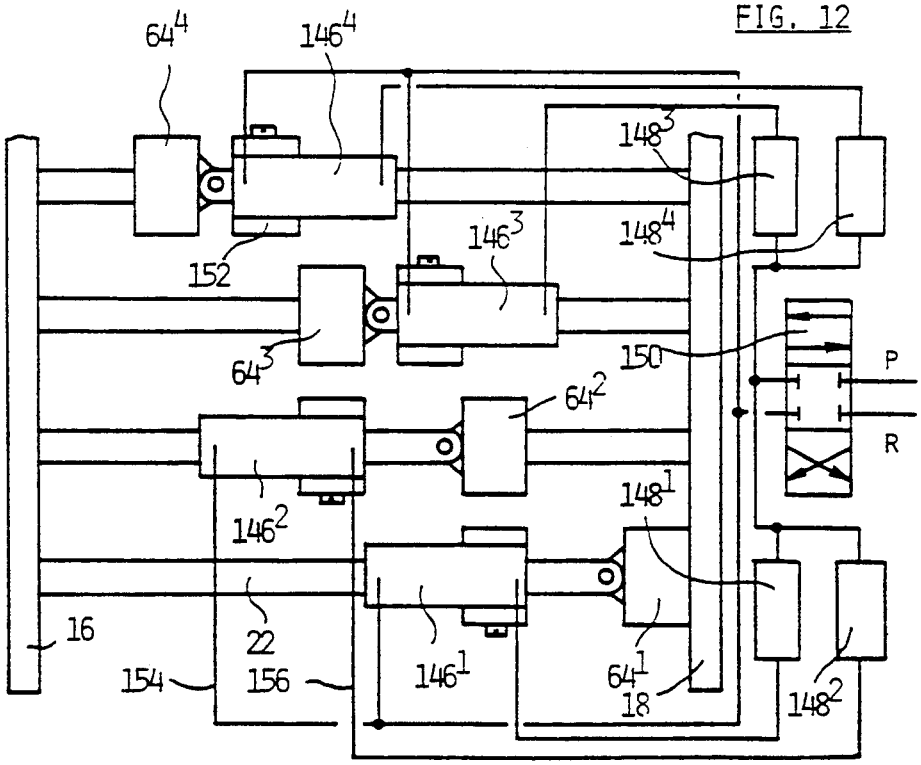

In the embodiment according to FIG. 13, hydraulic operating cylinders $\mathbf{146^i}$ are associated with the drive heads $\mathbf{64^i}$, which operating cylinders are supplied with pressure medium by way of quantity dividers $\mathbf{148^i}$ and a control valve 150. The quantity dividers $\mathbf{148^i}$ ensure that the piston rods of the operating cylinders $\mathbf{148^1}$ to $\mathbf{148^4}$ again move in the ratio 1:2:3:4. In order to be able to use the same operating cylinders in a uniform manner, the latter are fixed using clamping members 152 in the vicinity of the associated drive head 64 on the associated guide rail 22, the operating cylinders located on the two sides of the central plane of the apparatus being aligned in opposite directions, which is compensated for by corresponding exchange of their working lines 154 and 156.

It will be understood that in the above-described embodiments, one can increase or even reduce the total number of nozzle bars 42, in which case the differences in the adjusting movements are then selected to correspond to the varied number of bars.

I claim:

1. Apparatus for dusting printed products with fine powder, including a frame part and a nozzle body arrangement comprising a plurality of bar-shaped nozzle bodies supported by said frame part and arranged at spaced intervals, and means for continuously adjusting the intervals between the nozzle bodies including an individual actuating member.

2. Apparatus according to claim 1, characterized in that the interval adjustment means comprises operating cylinders (146) operated by a pressure medium, said cylinders each associated with one of the nozzle bodies (42) and a control unit (74) for synchronizing the supply of pressure medium to the operating cylinders.

3. Apparatus according to claim 1 characterized in that the interval adjustment means comprises pressing members (36, 64) able to move with respect to each other and springs (72) located between adjacent nozzle bodies (42).

4. Apparatus according to claim 3, characterized in that the pressing members (36, 64) are connected to external nozzle bodies (42) of the nozzle body arrangement.

5. Apparatus according to claim 1, including slidably mounted individually controllable switching couplings and the interval adjustment means comprises a drive rod (26), connectable to the nozzle bodies (42) by said individually controllable switching couplings; and a control circuit (74) for actuating the switching coupling, and a selection member (76; 80) cooperable with said control circuit.

6. Apparatus according to claim 5, characterized in that the interval adjustment means comprise brakes (90) actuated in phase opposition with the controllable switching couplings which brakes cooperate with a guide bar (22) for the nozzle bodies (42).

7. Apparatus according to claim 5, characterized in that the interval adjustment means comprises a thread drive (26, 66; 26, 86) driven by a servo motor (30) and the switch couplings have nut segments (86), which are supported by a lever (82) mounted to rotate on the housing (96) of the nozzle bodies (42).

8. Apparatus according to claim 7, characterized in that a further arm (88) of the lever (82) supports a brake member (90) cooperating with the brake bar (22).

9. Apparatus according to claim 1, characterized in that the interval adjustment means comprises an elongated reaction member (26) and drive heads (64) travelling thereon and a control unit (74) being provided for each of the nozzle bodies (42) for determining the movement of the various drive heads (64).

10. Apparatus according to claim 9, characterised in that the reaction body (26) comprises a threaded spindle or toothed rack and the drive head (64) comprises threaded sleeves (118) cooperating with the threaded spindle or pinions cooperating with the toothed rack.

11. Apparatus according to claim 1, characterized in that the interval adjustment means comprises belt or chain drives (130, 140–144), which are each associated with one of the nozzle bodies (42) and a control unit (74) for determining the movement of the various nozzle bodies.

12. Apparatus according to claim 1 characterized in that the interval adjusting means comprise a lazy tongs arrangement, having individual links pivotally connected to each other and to the nozzle bodies.

13. Apparatus according to claim 1, characterized in that the interval adjustment means comprises separate thread sections (124*a* to 124*d*) as well as drive heads (64) travelling thereon, which are each associated with one of the nozzle bodies (42).

14. Apparatus according to claim 13, characterised in that at least partial groups of the thread sections (124*a* to 124*d*) have a different pitch and are supported by a common spindle (26′ or 26″).

15. Apparatus according to claim 14, characterised in that adjacent thread sections (124*a* to 124*d*) of different pitch are arranged on different threaded spindles (26′, 26″).

16. Apparatus according to claim 13 characterised in that at least one partial group of the thread sections have the same pitch and are driven by drive shafts travelling at different speeds (132$^1$ to 132$^4$; 138$^1$ to 138$^4$, a control arrangement (74) determining the speed ratio of these drive shafts.

17. Apparatus according to claim 1, characterized by means (108) for adjusting the width of the jet produced by the nozzles bodies (42) in synchronism with the adjustment of the intervals between the nozzle bodies (42).

18. Apparatus according to claim 17, characterised in that the nozzle bodies (42) comprise tilting flaps (102, 104) defining the jet characteristics and the tilting flaps of adjacent nozzle bodies are pivotally connected by coupling members (108).

19. Apparatus according to claim 18, characterised in that the coupling members (108) are constructed as plates closing the gaps between the tilting flaps (102, 104).

20. Apparatus according to claim 1, characterized in that said nozzle bodies have end sections and a set of interval adjustment means is associated with the end sections of the nozzle bodies.

21. Apparatus according to claim 20, characterized in that two sets of interval adjustment means are provided and means for actuating each set independently of the other set, the end sections of the nozzle bodies being connected pivotally to the interval adjustment means, and at least one end section of the nozzle bodies being connected in a slidable manner to the associated interval adjustment means.

22. Apparatus according to claim 20, characterized in that the interval adjustment means are positively coupled for a common, identical adjustment of the nozzle bodies (42).

* * * * *